United States Patent [19]

Beezley et al.

[11] 4,227,461

[45] Oct. 14, 1980

[54] DUAL OUTPUT SIMULTANEOUS FIRING CIRCUIT

[75] Inventors: Dale L. Beezley, Sunnyvale; Wolf Goodman, Mountain View, both of Calif.

[73] Assignee: The United States of America as represented by the Secretary of the Navy, Washington, D.C.

[21] Appl. No.: 941,092

[22] Filed: Sep. 8, 1978

[51] Int. Cl.[3] ..... F42C 11/00

[52] U.S. Cl. ..... 102/218

[58] Field of Search ..... 102/218, 219, 220, 206, 102/217

[56] References Cited

U.S. PATENT DOCUMENTS

| | | | |
|---|---|---|---|
| 2,921,522 | 1/1960 | Apstein | 102/206 |
| 3,062,574 | 11/1962 | Buntenbach et al. | 102/206 |
| 3,275,884 | 9/1966 | Segall et al. | 102/217 |
| 3,288,068 | 11/1966 | Jefferson et al. | 102/218 |
| 3,570,404 | 3/1971 | Pope | 102/207 |
| 3,571,605 | 3/1971 | Dobson et al. | 102/217 |
| 3,651,760 | 3/1972 | Held | 102/218 |

*Primary Examiner*—Charles T. Jordan

*Attorney, Agent, or Firm*—R. S. Sciascia; Charles D. B. Curry; Francis I. Gray

[57] ABSTRACT

A dual output simultaneous firing circuit which provides a means for exploding fuse wires with a simultaneity of 20 to 200 nanoseconds even though the breakdown voltages of the fuse safety gaps have a large disparity. A DC voltage charges high voltage capacitors. When the charge voltage reaches the lower breakdown voltage of one safety gap, that fuse explodes. A balancing transformer induces momentarily an equal voltage which adds to the existing voltage on the undischarged capacitor. The additional charge breaks down the other safety gap causing the other fuse to explode.

7 Claims, 1 Drawing Figure

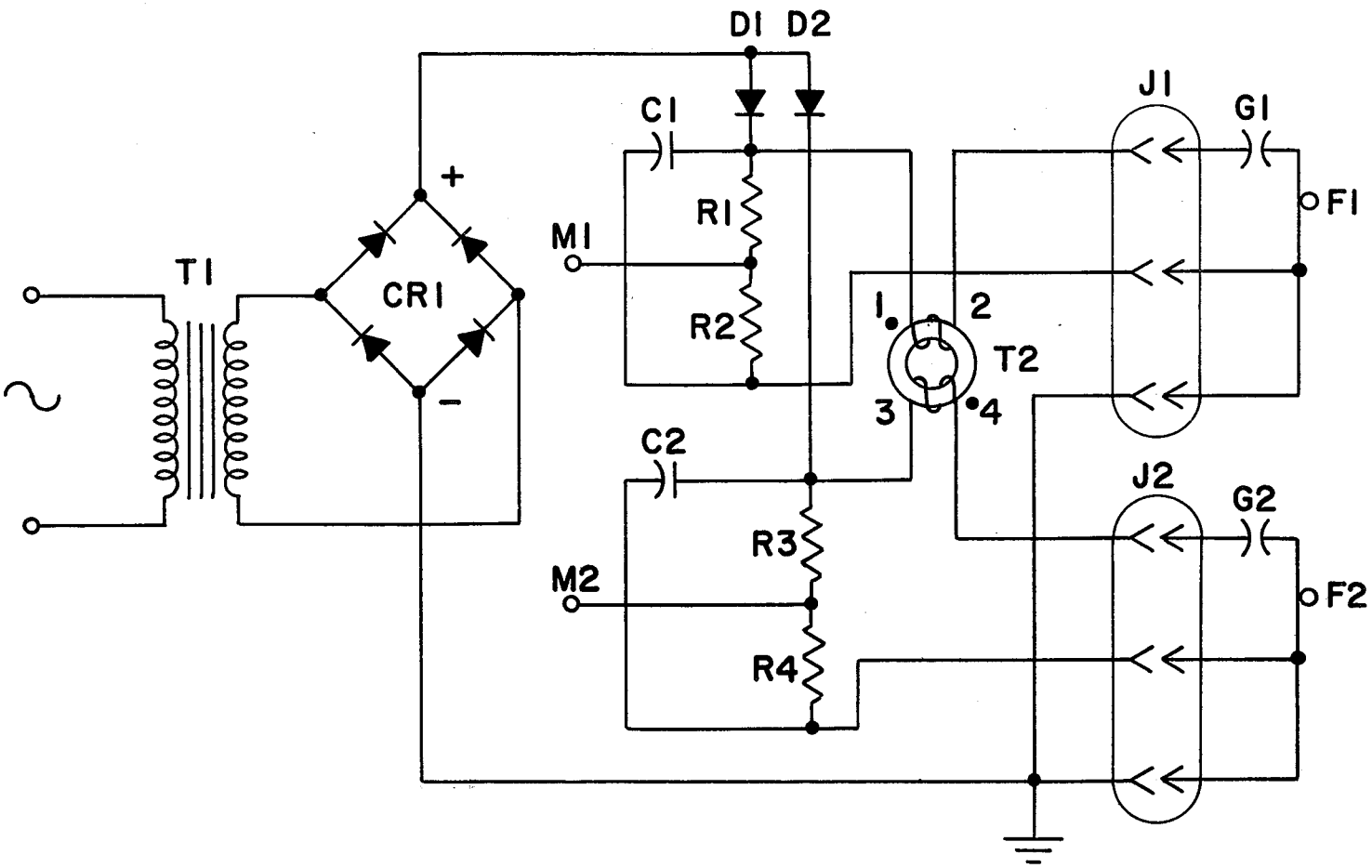
F1
F2
G1
G2
J1
J2
T2
1
2
3
4
D1
D2
R1
R2
R3
R4
C1
C2
M1
M2
CR1
+
-
T1

DUAL OUTPUT SIMULTANEOUS FIRING CIRCUIT

BACKGROUND OF THE INVENTION

1. Field of the Invention

The present invention relates to fuse firing circuits, and more particularly to a fuse firing circuit for exploding two fuses simultaneously.

2. Description of Prior Art

For aerospace applications various vehicle events are triggered by pyrotechnic devices such as exploding bridgewire fuses. Many applications require the initiation of two events simultaneously or require redundancy to assure initiation of one event. Previous aerospace vehicles have used a single firing circuit for each pyrotechnic device. Due to the difference in characteristics between pyrotechnic devices, simultaneity of initiation was of the order of several milliseconds

SUMMARY OF THE INVENTION

Accordingly, the present invention provides a dual output simultaneous firing circuit for exploding fuse wires with a simultaneity of 20 to 200 nanoseconds even though the characteristics of the fuse safety gaps have a large disparity. A DC voltage charges two high voltage capacitors. When the charge voltage reaches the lower breakdown voltage of one safety gap, that capacitor discharges to explode one fuse. A balancing transformer, having each winding connected in series between a capacitor and fuse combination, momentarily induces an equal voltage which adds to the existing voltage on the undischarged capacitor. The additional voltage breaks down the other safety gap, causing the second fuse to explode.

Therefore, it is an object of the present invention to provide a firing circuit for detonating two pyrotechnic devices simultaneously.

Another object of the present invention is to provide a firing circuit which detonates two exploding bridgewire fuses simultaneously despite a safety gap breakdown voltage differential of two-to-one.

Yet another object of the present invention is to provide a firing circuit which detonates two fuses with a simultaneity of the order of 20 to 200 nanoseconds.

Other objects, advantages and novel features will be apparent from the following detailed description when read in conjunction with the appended claims and attached drawing.

BRIEF DESCRIPTION OF THE DRAWING

The FIGURE is a schematic diagram of a dual output simultaneous firing circuit according to the present invention.

DESCRIPTION OF THE PREFERRED EMBODIMENT

Referring now to the FIGURE an AC voltage is applied to the primary of a transformer T1. The secondary of the transformer T1 elevates the primary voltage to a high voltage AC. A full wave rectifier CR1 connected across the secondary of the transformer T1 converts the high voltage AC to a high voltage DC.

A first capacitor C1 and a second capacitor C2 are connected in parallel through optional isolation diodes D1, D2, respectively, on one side and through fuses F1, F2, respectively, via ground on the other side to the output of the full wave rectifier CR1. Each capacitor C1, C2 has a voltage divider network R1, R2, and R3, R4, respectively, connected across it. The voltage divider networks, R1, R2, and R3, R4, provide monitor points M1, M2 at the respective junctions of R1, R2 and R3, R4. The one side of the first capacitor C1 is connected also in series with one winding of a balancing transformer T2 to the safety gap G1 of the fuse F1. The one side of the second capacitor C2 is connected likewise in series with the other winding of the balancing transformer T2 to the safety gap G2 of the other fuse F2. The capacitors C1, C2 are connected to the balancing transformer T2 such that when one capacitor discharges through one winding a voltage is induced in the opposite winding which adds to the voltage of the other capacitor.

The high voltage DC from the full wave rectifier CR1 charges the capacitors C1, C2 through the respective ground returns. When the charge voltage on either capacitor C1 or C2 reaches the lower breakdown voltage of the two safety gaps G1, G2, the particular gap breaks down and causes that fuse F1 or F2 to explode. For example, if the safety gap G1 has the lower breakdown voltage, the fuse F1 explodes first and the voltage of the first capacitor C1 drops suddenly to zero. As the first capacitor C1 discharges the balancing transformer T2 winding 1–2 induces momentarily an equal voltage in winding 3–4 which adds to the existing charge on the second capacitor C2, causing the voltage on the second capacitor to momentarily double. The voltage on the second capacitor C2 is now sufficient to break down the other safety gap G2, causing the fuse F2 to explode. The time between detonations of the fuses F1, F2 is on the order of 20 to 200 nanoseconds.

The voltage divider networks R1, R2 and R3, R4 provide a means for monitoring at points M1, M2 the dynamic voltages of the capacitors C1, C2, respectively; and also provide a means for determining whether the fuses F1, F2 are properly mated at the connectors J1, J2. When the fuses F1, F2 are not connected, the appropriate monitor point M1, M2 indicates an open circuit to ground, while when properly mated a low resistance equivalent to R2 or R4 is indicated. The voltage divider networks R1, R2 and R3, R4 also serve as bleeder resistors for the capacitors C1, C2 when the fuses F1, F2 are disconnected.

The balancing transformer T2 does not degrade the output current amplitude or rise time since it is constructed of a square loop, i.e. Orthonol, torroid having three to six turns, resulting in a very low leakage inductance. If one safety gap G1, G2 is open circuited, very little degradation of output current occurs because the core saturates, whereas in normal operation the core is slightly below saturation.

Thus, the present invention provides a dual output simultaneous firing circuit which replaces a power circuit of two devices to reduce the number of components and total weight, and which reduces the simultaneity of detonation to 20 to 200 nanoseconds with an attendant overall increase in reliability.

We claim:

1. A dual output simultaneous firing circuit comprising:

(a) a first capacitor connected in parallel to a first fuse having a first gap such that when the charge on said first capacitor exceeds the breakdown voltage of said first gap, said first fuse explodes as said first capacitor discharges;

(b) a second capacitor connected in parallel to a second fuse having a second gap such that when the voltage on said second capacitor exceeds the breakdown voltage of said second gap, said second fuse explodes as said second capacitor discharges;

(c) means connected to said first and second capacitors for inducing an additive voltage to one of said capacitors when the other discharges; and (d) means for charging said first and second capacitors simultaneously to a high DC voltage when said fuses are connected.

2. A dual output simultaneous firing circuit as recited in claim 1 further comprising means for isolating said first and second capacitors.

3. A dual output simultaneous firing circuit as recited in claim 2 wherein said isolating means comprises:

(a) a first diode connected in series between said first capacitor and said charging means to isolate said first capacitor; and (b) a second diode connected in series between said first capacitor and said charging means to isolate said second capacitor.

4. A dual output simultaneous firing circuit as recited in claim 1 further comprising means for monitoring said dual output simultaneous firing circuit.

5. A dual output simultaneous firing circuit as recited in claim 4 wherein said monitoring means comprises:

(a) a first voltage divider network connected in parallel to said first capacitor to monitor the dynamic voltage of said first capacitor, to indicate whether said first fuse is connected, and to bleed said first capacitor when said first fuse is disconnected; and (b) a second voltage divider network connected in parallel to said second capacitor to monitor the dynamic voltage of said second capacitor, to indicate whether said second fuse is connected, and to bleed said second capacitor when said second fuse is disconnected.

6. A dual output simultaneous firing circuit as recited in claims 1, 3 or 5 wherein said inducing means comprises a balancing transformer having a first and second winding, said first winding being connected in series between said first capacitor and said first gap and said second winding being connected in series between said second capacitor and said second gap such that the discharge of one of said capacitors induces a voltage which adds to the charge of the other of said capacitors.

7. A dual output simultaneous firing circuit as recited in claim 6 wherein said charging means comprises:

(a) means for transforming a primary AC voltage to a high value AC voltage; and (b) means for converting said high value AC voltage to a high DC voltage to charge said first and second capacitors.

* * * * *